US005507127A

United States Patent [19]

Gates

[11] Patent Number: 5,507,127

[45] Date of Patent: Apr. 16, 1996

[54] ECOLOGICIAL BUILDING BLOCK INCLUDING SHREDDED, BALED TIRES

[76] Inventor: Raymond H. Gates, P.O. Box 1254, Port Allen, La. 70767

[21] Appl. No.: 332,930

[22] Filed: Nov. 1, 1994

[51] Int. Cl.[6] ..... E04C 1/40

[52] U.S. Cl. ..... 52/605; 52/DIG. 9; 241/DIG. 31

[58] Field of Search ..... 52/605, DIG. 9, 52/DIG. 7; 241/DIG. 31, DIG. 38

[56] References Cited

U.S. PATENT DOCUMENTS

| | | | |
|---|---|---|---|
| 3,685,244 | 8/1972 | Palmer | 52/DIG. 9 X |
| 4,726,530 | 2/1988 | Miller et al. | 241/24 |
| 5,214,897 | 6/1993 | Nordberg | 52/DIG. 9 X |
| 5,259,695 | 11/1993 | Mostkoff | 405/29 |
| 5,290,356 | 3/1994 | Frankowski | 52/DIG. 9 X |

FOREIGN PATENT DOCUMENTS

| | | | |
|---|---|---|---|
| 384825 | 11/1964 | Switzerland | 52/605 |
| 357888 | 10/1931 | United Kingdom | 52/605 |
| 1202092 | 8/1970 | United Kingdom | 52/DIG. 9 |

OTHER PUBLICATIONS

Gazette "The Straw—Bale Bungalow;" Myhrman, Dec. 1992.

*Primary Examiner*—Carl D. Friedman
*Assistant Examiner*—Christopher Todd Kent
*Attorney, Agent, or Firm*—Reginald F. Roberts, Jr.

[57] ABSTRACT

A concrete building block for erecting a wall and/or disposing of used rubber tires and other waste material detrimental to the environment. The block is made up of three rectangular portions, and includes a central chamber in which a bale of used rubber tires is encased. The tongue-and-groove design of the block facilitates the construction of a strong wall by joining the blocks end-to-end, with the tongue of one block disposed in the groove of another.

5 Claims, 3 Drawing Sheets

ECOLOGICIAL BUILDING BLOCK INCLUDING SHREDDED, BALED TIRES

BACKGROUND OF THE INVENTION

The present invention relates to waste disposal. More particularly, the invention relates to the disposal of used rubber tires and other waste materials which are deleterious to the environment.

The accumulation of used rubber tires poses a hazard to the environment. Stockpiles or landfills of such tires attract vermin, rodents, insects, and other disease-carrying organisms. Burning the tires results in pollution of the atmosphere with gases such as sulfur dioxide, carbon dioxide, and carbon monoxide, as well as with particulate matter such as smoke or soot. Even more importantly, when tires are burned, the conflagration releases oil which often contaminates groundwater.

A need exists for a method for disposing of such tires in a manner which is environmentally safe. The present invention provides such a method, as well as a block useful for erecting a wall, thereby solving the problem of pollution and at the same time providing an added benefit or bonus.

SUMMARY OF THE INVENTION

In general, the present invention in a first aspect provides a building block for a wall. The block comprises a first substantially rectangular portion having a top, a bottom, outer and inner sides, and first and second ends; a second substantially rectangular portion having a top, a bottom, outer and inner sides, and first and second ends; and a third substantially rectangular portion having a top, a bottom, first and second sides, and first and second ends. The third rectangular portion is asymmetrically disposed between the first and second portions in a configuration whereby the top of the third portion extends above the tops of the first and second portions, the bottoms of the first and second portions extend below the bottom of the third portion, the first ends of the first and second portions extend beyond the first end of the third portion, and the second end of the third portion extends beyond the second ends of the first and second portions.

In a second aspect the present invention provides a method for disposing of used rubber tires. The method comprises encasing the tires in a concrete block.

In a third aspect the invention provides a method for erecting a wall. The method comprises providing a plurality of building blocks, each of the blocks having a first substantially rectangular portion comprising a top, a bottom, outer and inner sides, and first and second ends, a second substantially rectangular portion comprising a top, a bottom, outer and inner sides, and first and second ends, and a third substantially rectangular portion comprising a top, a bottom, first and second sides, and first and second ends. The third rectangular portion is asymmetrically disposed between the first and second rectangular portions in a configuration whereby the top of the third rectangular portion extends above the tops of the first and second rectangular portions, the bottoms of the first and second rectangular portions extend below the bottom of the third rectangular portion, the first ends of the first and second rectangular portions extend beyond the first end of the third rectangular portion, and the second end of the third rectangular portion extends beyond the second ends of the first and second rectangular portions, thereby defining a horizontal groove and a vertical groove in each of the blocks. The blocks are combined end-to-end in a configuration of first and second blocks whereby portions of the bottom and sides of the third rectangular portion of the second block are disposed in the vertical groove in the first block, and the second end of the third rectangular portion of the second block is juxtaposed and proximate to and horizontally displaced from the first end of the third rectangular portion of the first block. The foregoing procedure is repeated until a wall of a desired length is formed.

In a fourth aspect the invention provides a unit for the disposal of used rubber tires. The disposal unit comprises a sealed concrete block including a cavity, and a plurality of used rubber tires disposed in the cavity.

In a fifth aspect the present invention provides a wall. The wall comprises a plurality of building blocks. Each of the blocks has a first substantially rectangular portion comprising a top, a bottom, outer and inner sides, and first and second ends; a second substantially rectangular portion comprising a top, a bottom, outer and inner sides, and first and second ends; and a third substantially rectangular portion comprising a top, a bottom, first and second sides, and first and second ends. The third rectangular portion is asymmetrically disposed between the first and second rectangular portions in a configuration whereby the top of the third rectangular portion extends above the tops of the first and second rectangular portions, the bottoms of the first and second rectangular portions extend below the bottom of the third rectangular portion, the first ends of the first and second rectangular portions extend beyond the first end of the third rectangular portion, and the second end of the third rectangular portion extends beyond the second ends of the first and second rectangular portions, thereby defining a horizontal groove and a vertical groove in each of the blocks. The building blocks are combined end-to-end in a configuration of first and second blocks whereby parts of the bottom and sides of the third rectangular portion of the second block are disposed in the vertical groove in the first block, and the second end of the third rectangular portion of the second block is juxtaposed and proximate to and horizontally displaced from the first end of the third rectangular portion of the first block.

DETAILED DESCRIPTION OF THE INVENTION

Figure 1:
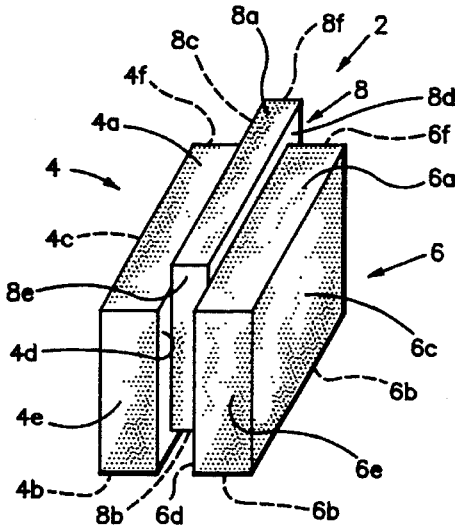
FIG. 1 is an oblique view from one end of a block made in accordance with the principles of the present invention.
Figure 2:
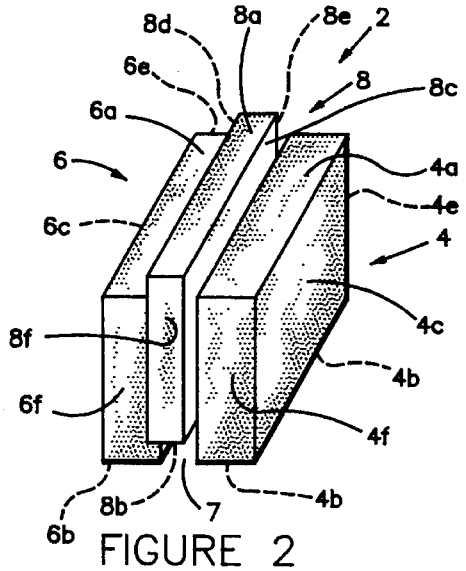
FIG. 2 is an oblique view from the opposite end of the block shown in FIG. 1.
Figure 3:
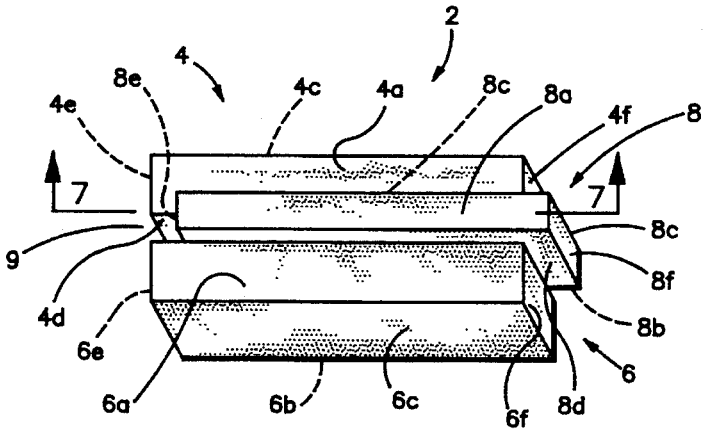
FIG. 3 is an oblique top view of the block shown in FIGS. 1 and 2.

More specifically, reference is made to FIGS. 1–3, in which is shown a block made in accordance with the principles of the present invention, generally designated by the numeral 2.

The block 2 is constructed and arranged for building a wall, and for the storage and disposal of used rubber tires and other waste material posing a disposal problem and a hazard to the environment. The block 2, which is preferably made of concrete, comprises a first substantially rectangular portion 4 having a top side 4*a*, a bottom side 4*b*, outer and inner lateral sides 4*c* and 4*d*, respectively, and first and second ends 4*e* and 4*f*, respectively. A second substantially rectangular portion 6 includes a top side 6*a*, a bottom side 6*b*, outer and inner lateral sides 6*c* and 6*d*, respectively, and first and second ends 6*e* and 6*f*, respectively. The first and second rectangular portions 4 and 6 have substantially the same structure, size, and geometry.

The block 2 further comprises a third substantially rectangular portion 8 having a top side 8*a*, bottom side 8*b*, first and second lateral sides 8*c* and 8*d*, respectively, and first and second ends 8*e* and 8*f*, respectively. The lateral sides 8*c* and 8*d* of the third rectangular portion 8 are closer together than the lateral sides of the first and second rectangular portions 4 and 6. Stated differently, the third rectangular portion 8 is narrower and has a narrower top side 8*a*, a narrower bottom side 8*b*, and narrower first and second ends 8*e* and 8*f* than the first and second rectangular portions 4 and 6.

The third rectangular portion 8 is asymmetrically disposed between the first and second rectangular portions 4 and 6 in a configuration whereby the top side 8*a* of the third rectangular portion 8 extends above the top sides 4*a* and 6*a* of the first and second rectangular portions 4 and 6, the bottom sides 4*b*, 6*b* of the first and second rectangular portions 4 and 6 extend below the bottom side 8*b* of the third member 8, the second end 8*f* of the third rectangular portion 8 extends beyond the second ends 4*f*, 6*f* of the first and second rectangular portions 4 and 6, and the first ends 4*e* and 6*e* of the first and second rectangular portions 4 and 6 extend beyond the first end 8*e* of the third rectangular portion 8, thereby defining a horizontal groove 7 and a vertical groove 9 in the first block 2. The part of the third rectangular portion 8 extending above the tops 4*a*, 6*a* and beyond the ends 4*f*, 6*f* of the first and second rectangular portions 4, 6 of the block 2 constitute a tongue which is insertable in the grooves 7 and 9 of another block 2.

Figure 7:
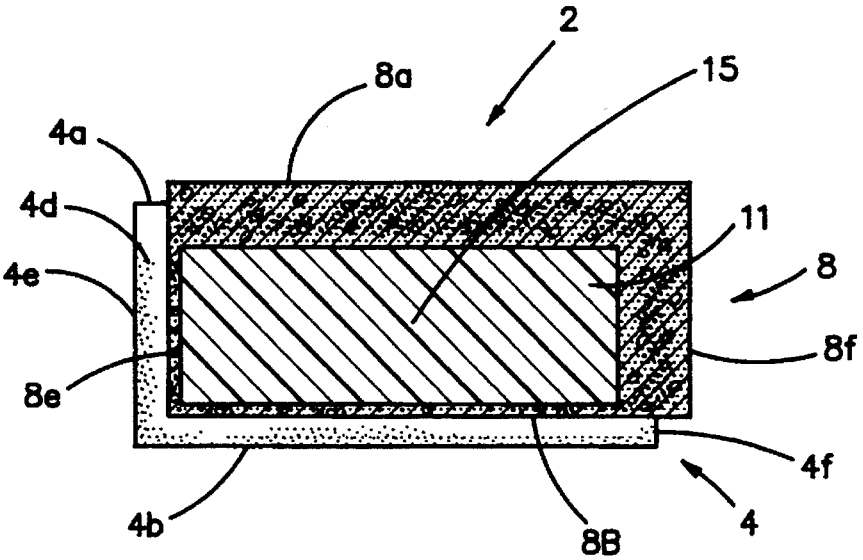
FIG. 7 is a cross-sectional view of the blocks shown in FIG. 3, taken along the cutting line 7—7.

Reference is now made to FIG. 7, which shows that the block 2 includes a central chamber 11 comprising about one-half the volume of the block 2. The chamber 11 is beneficially filled with and used to contain compressed used rubber tires 15. The thickness of the concrete wall surrounding the chamber 11 depends upon the volume of the block 2, the volume of the chamber 11, the number of tires 15, and the space separating the tires 15 from the concrete wall comprising the sides 4*a*, 4*b*, 4*c*, 4*e*, 4*f*, 6*a*, 6*b*, 6*e*, 6*f*, 8*a*, and 8*b*. It will be apparent that the chamber 11 extends through the sides 4*d* and 6*d* of the first and second rectangular portions 4 and 6, and through the sides 8*c* and 8*d* of the third rectangular portion 8.

Figure 5:
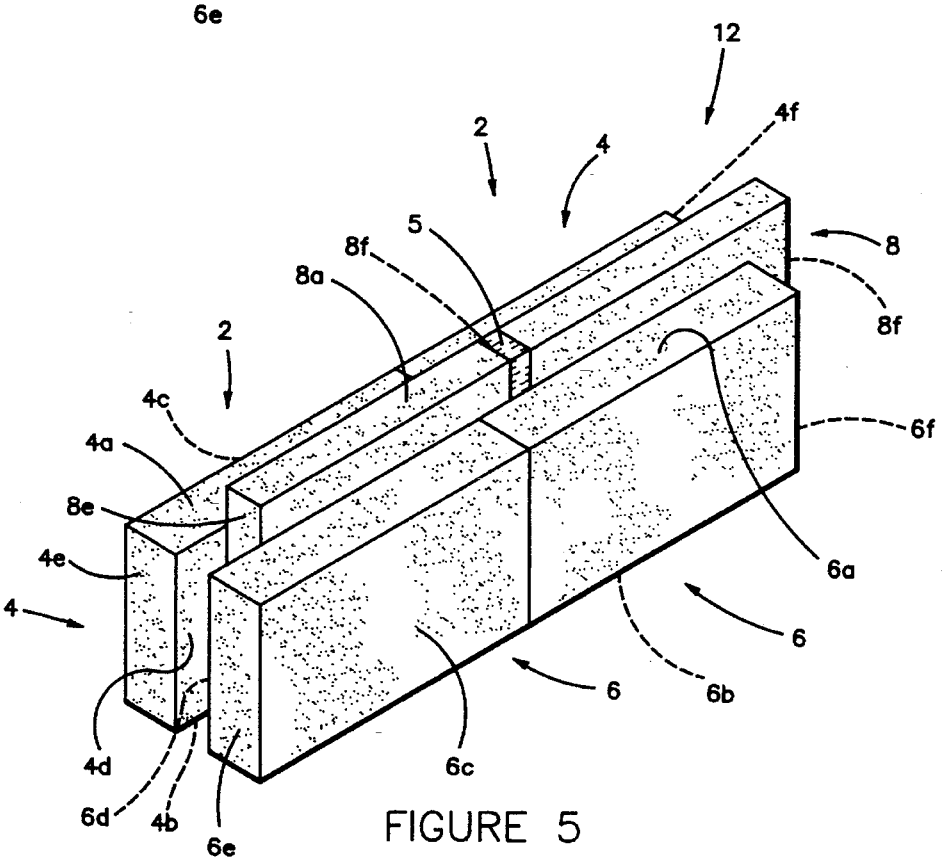
FIG. 5 is a perspective view of first and second blocks joined end-to-end.

Although the size of the block 2 may vary, suitable dimensions are about four feet in depth and height, and about eight feet in length. The geometry of the block 2 enables each block 2 to slide and lock into another block 2, end-to-end, to form a single wall about four feet high of any length. Reference is now made to FIG. 5, in which is shown such a horizontal combination, generally designated as 12, of first and second blocks 2, and which will be most clearly understood by reference to FIGS. 1–3 for the structure of the individual blocks 2. In this horizontal arrangement 12 the individual blocks 2 are aligned end-to-end, with the block 2 on the right as viewed in FIG. 5 being designated as the first block 2, and the block 2 on the left as seen in FIG. 5 being designated as the second block 2. Parts of the inner sides 4*d* and 6*d* of the first and second portions 4 and 6 and the first end 8*e* of the third portion 8 of the first block 2 define therebetween a vertical groove 9, shown in FIG. 3. A part of the tongue comprising portions of the bottom side 8*b* and first and second sides 8*c* and 8*d* of the third rectangular portion 8 of the second block 2 is disposed in the groove 9 of the first block 2. The second end 8*f* of the third portion 8 of the second block 2 is juxtaposed and proximate to the first end 8*e* of the third portion 8 of the first block 2. A layer 5 of a water-resistant material is disposed between the end 8*e* of the first block 2 and the end 8*f* of the second block 2. Preferably, the distance separating the ends 8*e* and 8*f* and the thickness of the layer 5 of water-resistant material is about one inch. Even more preferably, the water-resistant material is composed of granulated rubber made from used rubber tires.

Figure 4:
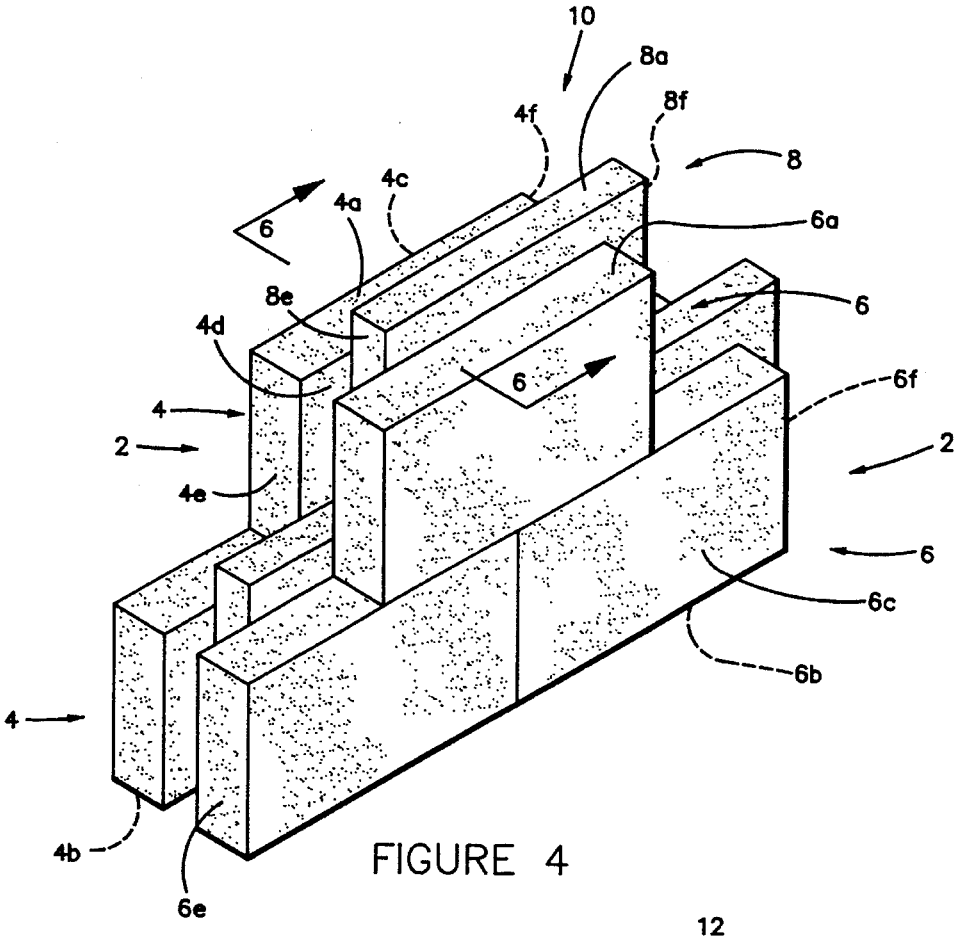
FIG. 4 is a perspective view of first and second blocks joined end-to-end, and a third block stacked vertically above and joined to the first and second blocks..
Figure 6:
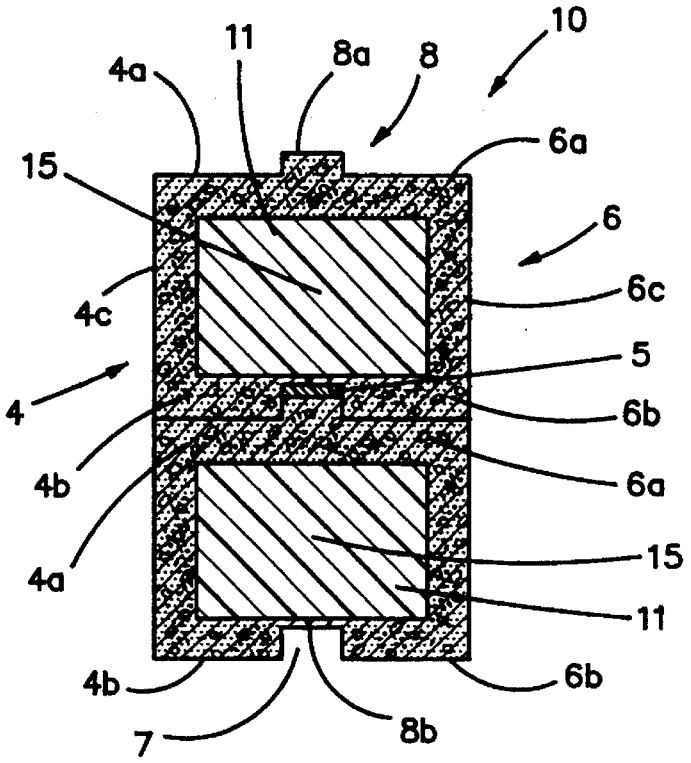
FIG. 6 is a cross-sectional view of the blocks shown in FIG. 4, taken along the cutting line 6—6.

When the blocks 2 are stacked vertically, with joints alternating, they form an interlocking wall of great strength. Reference is now made to FIGS. 4 and 6, in which is shown such a vertical combination, generally designated by the number 10, of first and second blocks 2, and which will be most easily understood by referring to FIGS. 1–3 for the structure of the individual blocks 2. In this vertical arrangement 10 the individual blocks 2 are stacked one on top of the other, in a staggered configuration as shown, the upper block 2 being designated the third block 2, and the lower blocks 2 being designated the first and second blocks 2 as in FIG. 5. The bottom side 8*b* of the third rectangular portion 8 and the inner lateral sides 4*d* and 6*d* of the first and second portions 4 and 6 of the third block 2 define therebetween a horizontal groove 7, as shown in FIGS. 1 and 2. A part of the tongue comprising the top side 8*a* and a part of the first and second lateral sides 8*c* and 8*d* of the third portion 8 of the first and second blocks 2 are disposed in the groove 7. The bottom sides 4*b* and 6*b* of the first and second portions 4 and 6 of the third block 2 are in contact with part of the top sides 4*a* and 6*a* of the first and second portions 4 and 6, respectively, of the first and second blocks 2. The bottom side 8*b* of the third portion 8 of the third block 2 is juxtaposed and proximate to the top sides 8*a* of the third portions 8 of the first and second blocks 2. A layer 5 of a water-resistant material is disposed between the bottom side 8*b* of the third block 2 and the top sides 8*a* of the first and second blocks 2. The distance separating the bottom side 8*b* of the third portion 8 of the third block 2 from the top sides 8*a* of the third portions 8 of the first and second blocks 2, and the thickness of the layer 5 of water-resistant material is about one inch. The water-resistant material 5 is preferably composed of granulated rubber made from used rubber tires.

From the foregoing description it will be apparent that the building block 2 is a large concrete block which has a useful and distinctive shape and purpose. Its preferred dimensions are approximately four feet in width and height and eight feet in length, although the size may vary. The block 2 incorporates a tongue-and-groove rectangular design which enables each block 2 to slide and lock into another block 2 end-to-end to form a single wall four feet in height of any given length. This interlocking feature and attendant strength results from the block's unique shape.

Another feature designed into the building block 2 is a hollow central chamber that holds approximately one-half of the block's volume in compressed and hard-to-dispose-of waste rubber tires and/or if used in residential walls, other waste or insulating material.

The building block 2 is designed with about a one-inch air space between the top of the tongue and the deepest point in the groove when the blocks are placed together either end-to-end or stacked vertically. This design feature allows for the installation of a weather/moisture-proofing pad or seal that will run the full length of each tongue and groove joint.

The building block 2 was invented to alleviate the waste-tire problem in the United States in a way that would also benefit the public in other ways. The chamber 11 in the block is capable of holding and effectively disposing of approximately seventy-five waste tires 15 when the tires have been baled. Of course the size of the block and the number of used tires encased therein can be altered as may be desired.

The method for encasing the tires 15 in a concrete block 2 is as follows.

A hollow form having a geometry capable of generating the block 2 is filled with concrete to just above the level required to form the bottom sides 4*b*, 6*b*, and 8*b* of the first, second and third rectangular portions 4, 6, and 8, respectively, of the block 2. A bale of tires 15 is then disposed in the form in an amount to occupy approximately one-half the volume of the form. Preferably the tires 15 are shredded and compressed before baling. A lid is placed over the top of the form, and the remainder of the form is filled with concrete through a central opening in the highest part of the lid until the concrete is level with or overflows the opening therein. The lid has a geometry capable of generating the tops 4*a*, 6*a*, and 8*a* of the first, second, and third rectangular portions 4, 6, and 8, respectively, of the block 2. After the concrete has been poured and has hardened, the lid is removed, and the block 2 is taken out of the form.

In addition to the disposition of used rubber tires and other waste material and the erection of strong walls, other uses for the block include: highway blocking/closing to contain falling rocks, hillside areas, etc.; security barriers for embassies and military facilities; flood-control dikes; sound barriers to protect residential areas; traffic diversion and control in roadside, state and national parks and municipalities; revetments for military and civilian aircraft; residential and/or commercial walls with various fillers; seawalls; firewalls, when filled with concrete; levelers, when making parking lots, etc., on sloping ground; retaining walls for bulk materials such as gravel, sand, etc.; walls for international border points; primary or supplemental dikes for hazardous materials and refinery holding tanks; dams for ponds and streams; erosion-control dikes or walls, with the tongues being optionally slightly offset for sloping walls; artificial offshore reefs; tables or containers for outdoor areas such as public parks; and decorative planters for municipalities, with a slightly altered design for the block 2.

While certain particular embodiments and details have been described to illustrate the present invention, it will be apparent to those skilled in the art that many modifications can be made therein without departing from the basic concept, spirit, and scope of the invention. It will likewise be apparent that the present invention represents a significant and important advance in protecting, safeguarding, and improving the quality of the environment.

I claim:

1. A unit for the disposal of used rubber tires, comprising:

(a) a sealed concrete block including a cavity, and (b) a bale of shredded used rubber tires disposed in the cavity.

2. The disposal unit of claim 1, wherein the block comprises:

(d) a first substantially rectangular portion having a top, a bottom, outer and inner sides, and first and second ends;

(e) a second substantially rectangular portion having a top, a bottom, outer and inner sides, and first and second ends; and (f) a third substantially rectangular portion having a top, a bottom, first and second sides, and first and second ends;

the third rectangular portion being asymmetrically disposed between the first and second portions in a configuration whereby the top of the third portion extends above the tops of the first and second portions, the bottoms of the first and second portions extend below the bottom of the third portion, the first ends of the first and second portions extend beyond the first end of the third portion, and the second end of the third portion extends beyond the second ends of the first and second portions.

3. The disposal unit of claim 2, wherein the first and second portions have substantially the same structure, size, and geometry; and the distance between the first and second sides of the third portion is substantially less than the distance between the outer and inner sides of the first and second portions.

4. A method for disposing of used rubber tires, which comprises the steps of:

(a) shredding the tires;

(b) pressing the shredded tires;

(c) baling the compressed, shredded tires; and (d) encasing the compressed, shredded tires in a concrete block.

5. A method for disposing of used rubber tires, which consists of the steps of:

(a) shredding the tires;

(b) compressing the shredded tires;

(c) baling the compressed, shredded tires; and (d) encasing the compressed, shredded tires in a concrete block.

* * * * *